US006601256B2

(12) United States Patent
Lee

(10) Patent No.: US 6,601,256 B2
(45) Date of Patent: Aug. 5, 2003

(54) AUTOMATIC CLEANSING DEVICE FOR OUTER WALL AND WINDOW-PANE OF BUILDING

(76) Inventor: Sang Woo Lee, 107=205 Eunhasoo Apartment 1104 Bisan-dong, Dongan-gu, Anyang-shi, Kyungki-do (KR)

( * ) Notice: Subject to any disclaimer, the term of this patent is extended or adjusted under 35 U.S.C. 154(b) by 48 days.

(21) Appl. No.: 09/918,217

(22) Filed: Jul. 30, 2001

(65) Prior Publication Data

US 2002/0032942 A1 Mar. 21, 2002

(30) Foreign Application Priority Data

Jul. 31, 2000 (KR) ..... 2000-21864

(51) Int. Cl.[7] ..... A47L 1/02
(52) U.S. Cl. ..... 15/50.3
(58) Field of Search ..... 15/50.1, 50.3, 15/52.1, 103

(56) References Cited

U.S. PATENT DOCUMENTS

| | | | | |
|---|---|---|---|---|
| 3,292,193 A | * 12/1966 | Littin | ..... | 15/50.3 |
| 4,198,724 A | 4/1980 | Fisher et al. | ..... | 15/302 |
| 5,465,446 A | 11/1995 | Chang | ..... | 15/50.3 |
| 5,715,557 A | 2/1998 | Hsu | ..... | 15/50.3 |
| 5,890,250 A | 4/1999 | Lange et al. | ..... | 15/50.3 |
| 6,170,109 B1 | 1/2001 | Jesadanont et al. | ..... | 15/50.3 |

FOREIGN PATENT DOCUMENTS

| | | | | |
|---|---|---|---|---|
| GB | 1038924 | * 8/1966 | ..... | 15/52.1 |
| SU | 638324 | * 12/1978 | ..... | 15/50.3 |

* cited by examiner

*Primary Examiner*—Mark Spisich

(57) ABSTRACT

The device capable of automatically cleansing an outer wall or window-pane of a building is characterized by the construction that support dies bent and folded by a cylinder are cross-formed, a brush rotating by a driving motor is installed on one side support die, and a weight plumb is set on another side support die, to whereby get an effective cleansing with only more simplified construction. In addition, in case that a boundary jaw or a projection appears, the cleansing work can be progressed moderately by unfolding and bending/folding the support die through a use of the cylinder so as to move the centroid, so by smoothly passing through the projection.

3 Claims, 6 Drawing Sheets

AUTOMATIC CLEANSING DEVICE FOR OUTER WALL AND WINDOW-PANE OF BUILDING

BACKGROUND OF THE INVENTION

1. Field of the Invention

The present invention relates to a device capable of automatically cleansing an outer wall or window-pane of a building; and more particularly, to an automatic cleansing device capable of automatically, easily, cleansing not only a flat outer wall of a building but also an outer wall of a building having an irregular wall face or a boundary jaw.

2. Description of the Prior Art

In general, in a method of cleansing an outer wall of a building it may be cleansed through a water spraying and cleaning method using a high-pressure hose in a case of a lower storied building. Such method is impossible to be used in a case of a higher storied building. That is, in the case of the higher storied building, a worker as manpower takes a ride in a scaffold dropped from a rooftop to a lower side thereof to clean window-pane and an outer wall of a building and to cleanse it by gradually lowering the scaffold. In such cleansable method of the higher storied building, unexpected sudden gust of wind may make the scaffold shake, and the worker standing on the scaffold always has a falling dancer since the worker should execute a cleansing work, hanging on a rope. Furthermore, there are problems that much working time is required and a cleansing efficiency drops.

In Korea Patent Application Nos. 98-1174 and 97-29848 to overcome the problems like the above, the automatic cleansing device ascending and descending by a rope had been ever proposed.

Such automatic cleansing device has an inside installation of a rotary brush which collides directly with window-pane or an outer wall of a building, and in the inside of a main body having the inside installation of such rotary brush, a rotating unit of the brush and a roller for moving the main body are set.

However, the afore-mentioned general automatic cleansing device was improved in an aspect of a stable cleansing efficiency for the outer wall and the window-pane of the building, meanwhile, there is a problem that the device could be used limitedly for only the flat outer wall of the building.

That is, in a case of reaching a projection jaw or a boundary jaw of the building during an ascending and descending, it is passed the projection or jaw as it is since an equipment capable of going over the projection was not arranged, and after that, a worker directly cleans an uncleansed part by lowering a scaffold later or the uncleansed part is left alone to thus cause a visually unsmooth imagination.

Furthermore, excessively complicated and many equipments are inside-installed in comparison with the cleansing efficiency, thus manufacture expenses thereof is so high and there also is an inconvenience in their maintenance management.

SUMMARY OF THE INVENTION

Accordingly, the present invention is directed to an automatic cleansing device of a building outer wall or window-pane that substantially obviates one or more of the limitations and disadvantages of the related art.

A primary object of the present invention is to provide an automatic cleansing device of outer wall or window-pane of a building, which is characterized by the construction that support dies bent and folded by a cylinder are cross-formed, a brush rotating by a driving motor is installed on one side support die, and a weight plumb is set on another side support die, to whereby get an effective cleansing with only more simplified construction. In addition, in case that a boundary jaw or a projection appears, the cleansing work can be progressed moderately by unfolding and bending/folding the support die through a use of the cylinder so as to move a weight center, so by smoothly passing through the projection.

BRIEF DESCRIPTIONS OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIG. 1 represents an overall perspective view of an automatic cleansing device in accordance with the present invention;

FIG. 2 indicates an installation state view of an automatic cleansing device in the present invention;

DESCRIPTION OF THE PREFERRED EMBODIMENT

Reference will now be made in detail to the preferred embodiments of the present invention, examples of which are illustrated in the accompanying drawings.

Figure 1:
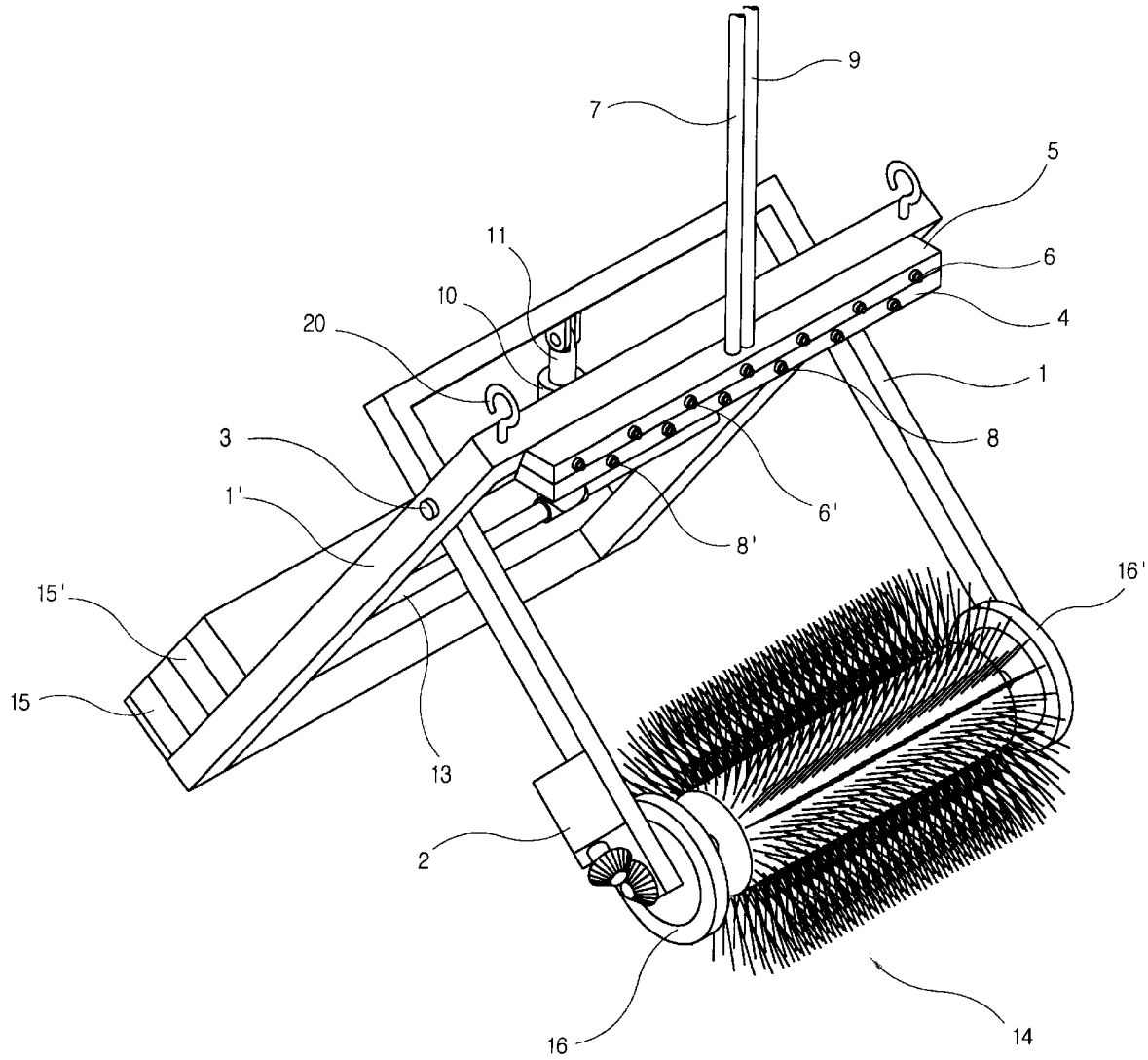
Figure 2:
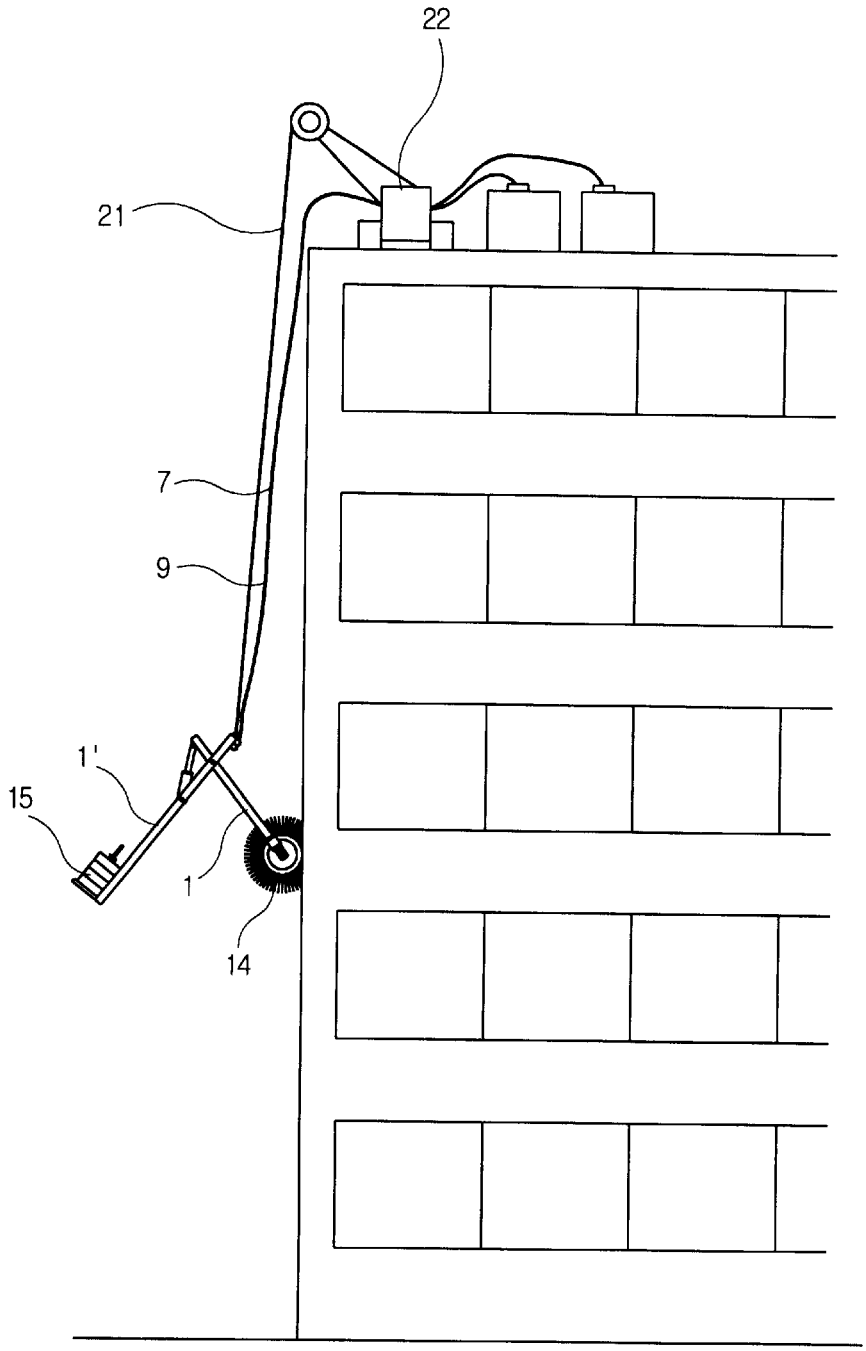

FIG. 1 represents an overall perspective view of an automatic cleansing device in accordance with the present invention, and FIG. 2 shows its installation state view.

In a general automatic cleansing device in which a rotary brush rotating by a driving motor is installed on one side thereof, and a detergent spraying unit and a cleansing-water spraying unit are formed, in accordance with the present invention, each of support dies based on a "Π" shape are separatedly formed, and its end is fixed in hinge 3 so as to be bent/folded and combined with each other, and in both sides of a one side support die 1 lower end part, guide rollers 16, 16' are axis-installed, and in its medium part, a rotary brush 14 rotating by a driving motor 2 is axis-installed, on an upper part of another side support die 1', numerous spraying nozzles 6, 6' have an installation of a cleansing-water spraying unit 5 connected to a water supply hose 7, and on its lower part, another numerous spraying nozzles 8, 8' have an installation of a detergent spraying unit 4 connected to a detergent supply hose 9, on a medium thereof, a cylinder 10 combined by a support rod 13 so as to be rotatable is set, and a cylinder shaft 11 of the cylinder 10 is hinge-combined with an end of the support die 1, and on a lower end part thereof, numerous weight bodies 15, 15' are insertion-fixed by an insertion rod 12 and constructed.

Further, on both side faces of one side support die 1, protective rails 17, 17' provided on endless tracks are installed, and on upper and lower both side parts of the another side support die 1', respective protective wheels 18, 18', 19, 19' are set.

In the drawing, unexplained characters 20 represent a hook, 21 a rope, and 22 an actuator.

The inventive operation for such construction is described more in detail with reference to the accompanied drawings, as follows.

As shown in FIG. 2, the inventive automatic cleansing device connected to the rope 21 can ascend and descend by the actuator 22 set in the rooftop of the building.

Such ascending and descending inventive automatic cleansing device pressurizes the support dies 1, 1' and the rotary brush 14 toward the building or the window-pane by load weight of the weight bodies 15, 15' inserted into a lower end part of the one side support die 1', therefore, the cleansing work can be gained under more stuck state.

In addition, such pressurized pressure does not influence directly upon the rotary brush 14, but influences upon the guide rollers 16, 16' formed on both sides of the rotary brush 14. That is, without an influence upon a rotation action of the rotary brush 14, the pressurized pressure is applied onto the outer wall of the building and the window-pane, to thereby maintain a constant distance always and increase a cleansing efficiency.

Further, the pressurized pressure is controlled by increasing and decreasing the number of the weight bodies 15, 15' having an insertion of the insertion rod 12, to make an efficient use thereof valid.

Figure 3:
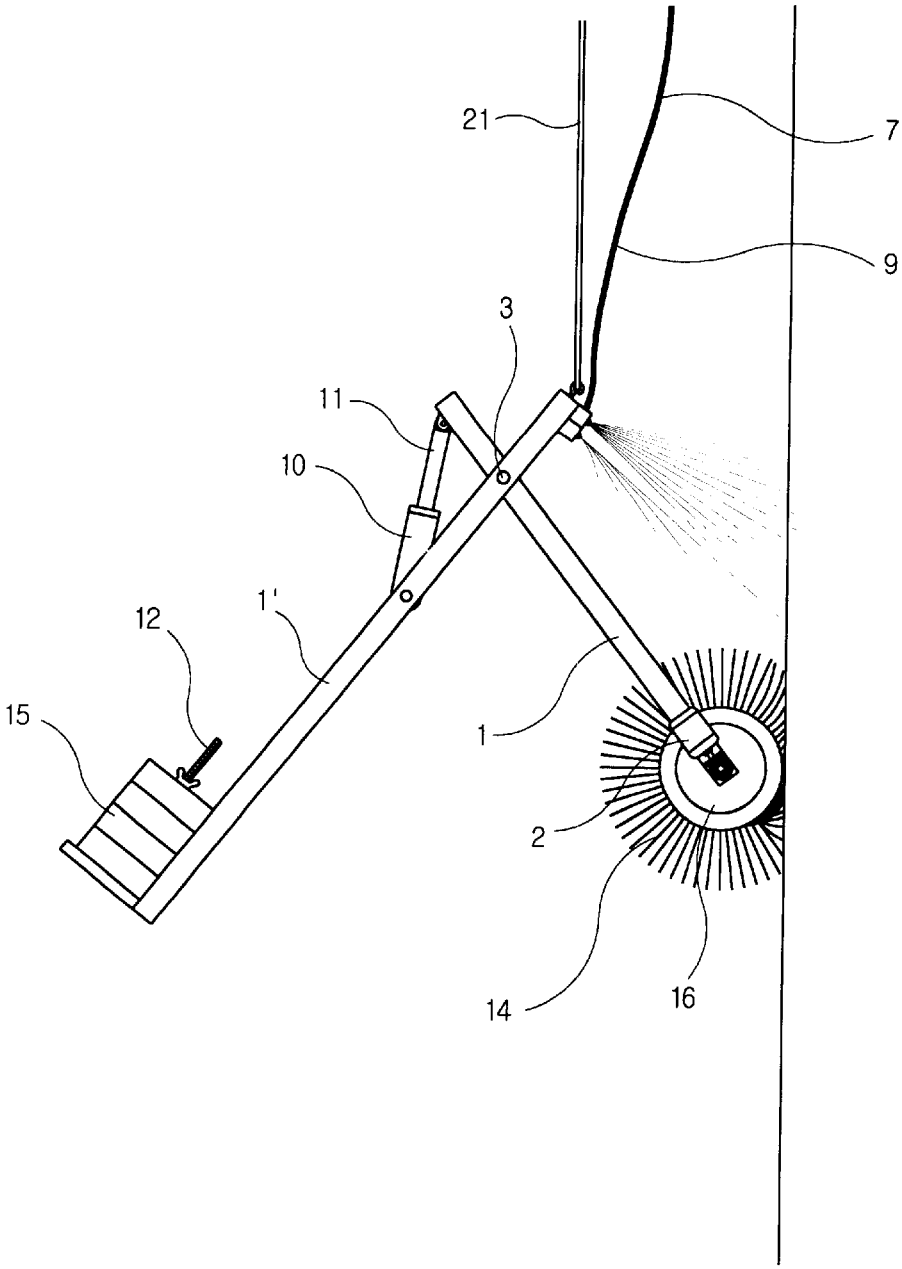
FIG. 3 illustrates a side explanatory view of an automatic cleansing device in the invention.

Describing such cleansing work more in detail referring to FIG. 3, the detergent and the cleansing-water are discharged through the detergent spraying unit 4 and the cleansing-water spraying unit 5 which are installed on the end of the one side support die 1', and the detergent and the cleansing-water is sprayed directly on the outer wall face of the building or on the window-pane.

At this time, it is passed through the procedures that a detergent work is executed by spraying only the detergent, then a condensing work is performed by spraying only the clear cleansing-water for a finishing work; or the procedures that the detergent and the cleansing-water are simultaneously sprayed on a portion like the outer wall of building where a stain is not remained so that the cleansing work can be finished with only one working procedure.

Also, as above-mentioned, when the detergent or the cleansing-water is sprayed from the detergent spraying unit 4 and the cleansing-water spraying unit 5, the driving motor 2 installed in a lower part of the one side support die 1 is driven, and the rotary brush 14 is rotated simultaneously to a rotation of the driving motor 2, to thereby cleanse the outer wall of the building and the window-pane.

At this time, in the rotary brush 14, rubber pad like rubber material having a constant elasticity is used preferably, and there is no matter to even use fiber material having an elasticity.

Figure 4:
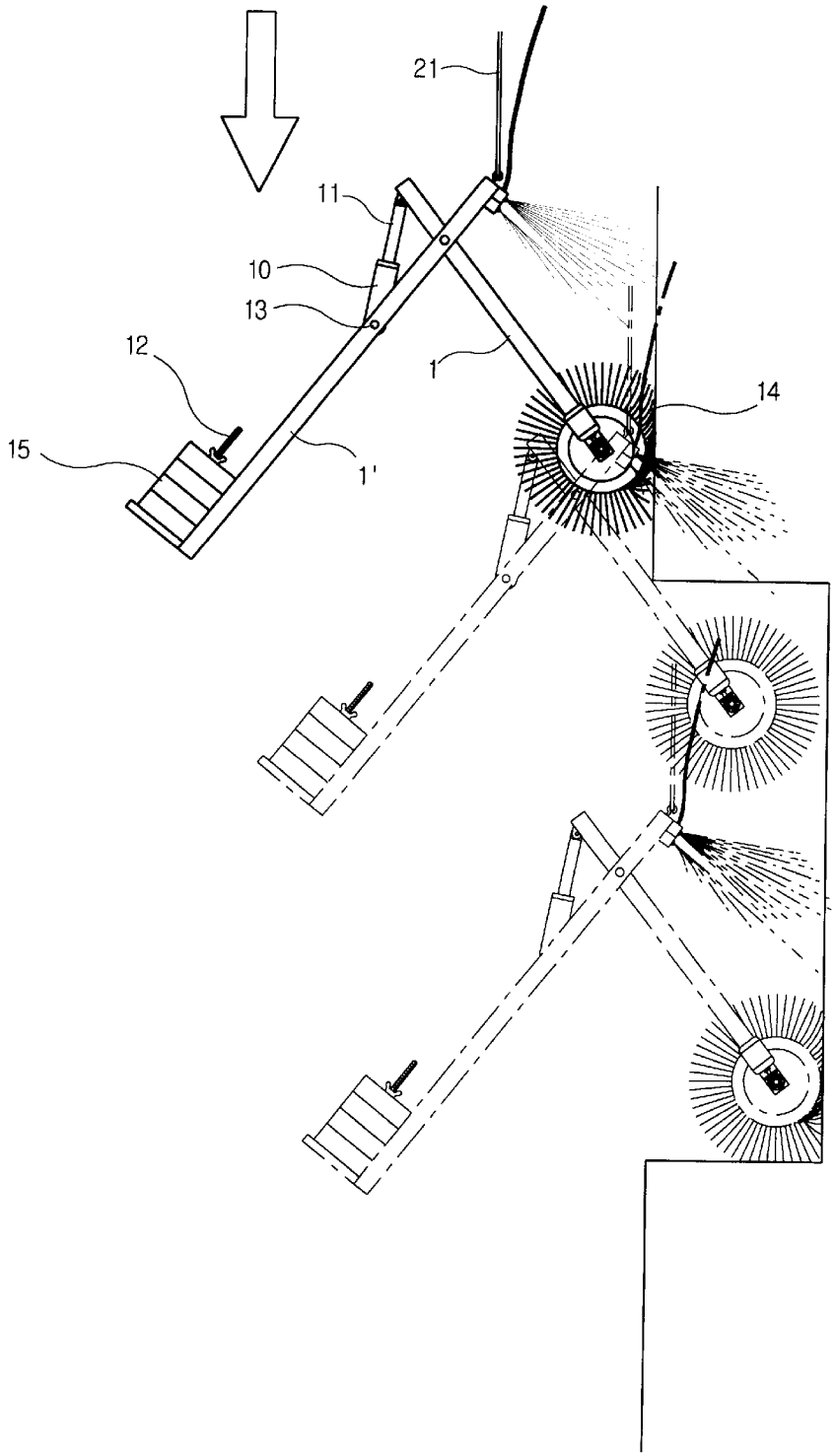
FIG. 4 depicts a dropping operational explanatory view of an automatic cleansing device in the invention.

Like this, in case that the rope 21 is hooked on the hook 20 formed in the upper end of the one side support die 1' and the inventive automatic cleansing device ascending and descending by the actuator 22 washes a building having a concave flute part as shown in FIG. 4, the device passes a flat face and reaches a boundary jaw of the concave flute part upper part, and the rotary brush 14 first goes down into the concave flute part, and then the support die 1 gradually falls down and slidingly enters into the concave flute part, being contacted with the upper boundary jaw.

Figure 5:
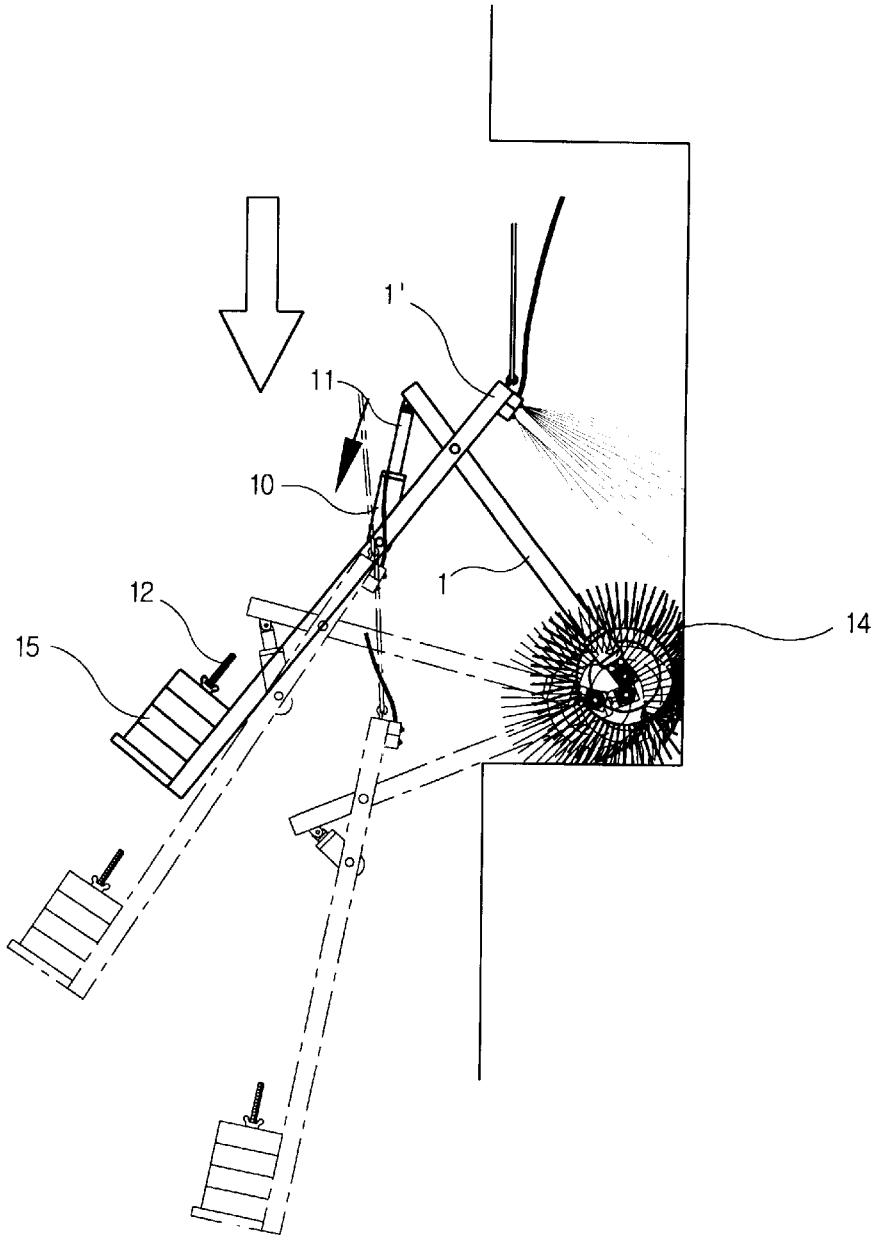
FIG. 5 shows a spread operational explanatory view of an inventive automatic cleansing device.

The rotary brush 14 entered into the concave flute part rotates continuously, cleansing a wall face or window-pane of the concave flute part, and then gets out of the concave flute part to the projection. Describing its operation, as shown in FIG. 5 the cylinder shaft 11 of the cylinder 10 operates so that each support die 1, 1' can be unfolded mutually, and the support die 1' having the installation of the weight bodies 15, 15' is unfolded to make the rope 21 fall, then the one side support die 1' also drops, and is detached from the concave flute part, sliding on a lower boundary jaw of the concave flute part.

Therefore, in case the cleansing work is executed for the outer wall of the building, the work can be easily done even in the concave flute part and the projection and further the device can easily get out of them, by the operation of the cylinder 10 and the cylinder shaft 11.

Accordingly, the inventive automatic cleansing device can easily gain a cleansing work of a building having a concave flute part and a projection jaw, overcoming a difficulty of a conventional automatic cleansing device.

Figure 6:
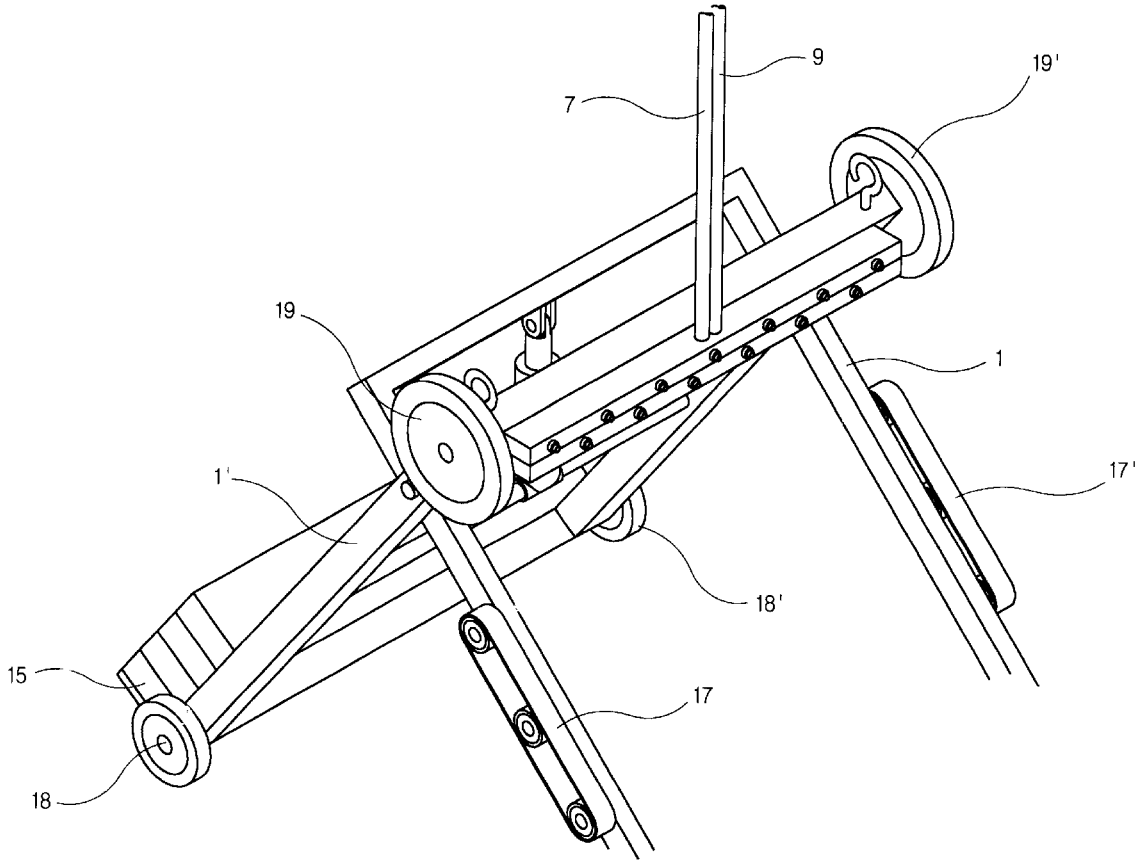
FIG. 6 provides another embodiment of an inventive automatic cleansing device.

In addition, as shown in FIG. 6, the protective rails 17, 17' on the endless tracks are installed on both side faces of the one side support die 1 and the track is made of rubber material having an elasticity, to thereby prevent the building or the window-pane from being broken owing to a collision between the upper part boundary jaw of the concave flute and the support die 1 in a case of cleansing a deep flute part like the concave flute part.

Further, specific protective wheels 18, 18', 19, 19' are shaft-installed on upper and lower both sides of the another side support die 1', to whereby prevent a use end part from being damaged or broken due to the collision with the outer wall of the building or the window-pane.

As afore-mentioned, in accordance with the present invention, the automatic cleansing device for a building's outer wall or a window-pane can obtain not only an effective cleansing with only more simplified construction, but also an effect of cleansing, naturally passing through the projection according that the support die is unfolded by the cylinder to move the centroid in case that the boundary jaw or the projection appear.

It will be apparent to those skilled in the art that various controls and variations can be made in the present invention without deviating from the spirit or scope of the invention. Thus, it is intended that the present invention cover the controls and variations of this invention provided they come within the scope of the appended claims and their equivalents.

What is claimed is:

1. An automatic cleaning device for cleaning an outer wall and window pane of a building by being moved relative to the outer wall of the building by an actuator operably coupled thereto, the cleaning device comprising:

a pair of support die members each having an "Π" shape and including an upper end and a lower end, the support members are pivotally coupled to each other about a hinge located intermediate the upper and lower ends thereof, the lower end of a first support member including a rotary brush in a middle portion thereof, which brush is driven by a motor such that it is rotatable about an axis generally parallel to the axis of the hinge, the lower end of the first support member also having a pair of guide rollers positioned adjacent respective ends of the rotary brush;

the upper end of a second support member including a water spraying unit operably coupled to a water supply hose and a detergent spraying unit operably coupled to a detergent supply hose, the second support member having a support rod between the upper and lower ends thereof;

a cylinder with a cylinder shaft is coupled between the support rod and the upper end of the first support member, an end of the cylinder being movably coupled to the support rod and an end of the cylinder shaft being movably coupled to the upper end of the first support member; and a plurality of weight bodies affixed to an insertion rod at the lower end of the second support member.

2. A device of claim 1 further comprising:

a pair of protective rails wherein each protective rail is located on a side of the first support die member intermediate the hinge and the guide roller; and a pair of protective wheels located on the lower end of the second support member and positioned adjacent respective ends of the weight bodies.

3. A device of claim 2 wherein the protective rail is formed by a continuous flexible loop mounted on rotating spools.

* * * * *